US010562162B2

(12) United States Patent
Ichikawa

(10) Patent No.: US 10,562,162 B2
(45) Date of Patent: Feb. 18, 2020

(54) CHAIN TOOL

(71) Applicant: BIB Creative Co., Ltd., Taichung (TW)

(72) Inventor: Tomonari Ichikawa, Taichung (TW)

(73) Assignee: BIB Creative Co., Ltd., Taichung (TW)

( * ) Notice: Subject to any disclaimer, the term of this patent is extended or adjusted under 35 U.S.C. 154(b) by 193 days.

(21) Appl. No.: 15/912,655

(22) Filed: Mar. 6, 2018

(65) Prior Publication Data

US 2018/0257208 A1 Sep. 13, 2018

(30) Foreign Application Priority Data

Mar. 9, 2017 (TW) ..... 106203316 U

(51) Int. Cl.
*B25B 27/22* (2006.01)
*B25B 27/00* (2006.01)
*B25B 15/00* (2006.01)

(52) U.S. Cl.
CPC ..... *B25B 27/22* (2013.01); *B25B 27/0071* (2013.01); *B25B 15/008* (2013.01)

(58) Field of Classification Search
CPC ..... B25B 27/0071; B25B 27/22; Y10T 29/49822; Y10T 29/53848; Y10T 29/53883
See application file for complete search history.

(56) References Cited

U.S. PATENT DOCUMENTS 1,436,429 A * 11/1922 Bean ..... B25B 27/22 59/7
5,140,736 A * 8/1992 Hsiao ..... B25B 27/0071 29/243.54
5,148,590 A * 9/1992 Wu ..... B25B 27/04 29/251
5,251,341 A * 10/1993 Seals ..... B25B 27/0071 280/288.4
7,409,817 B1 * 8/2008 Huang ..... B21L 21/00 29/243.53
8,925,167 B1 * 1/2015 Miller ..... B25B 27/023 254/20
2013/0263568 A1 * 10/2013 Chamberlain ..... B25B 27/22 59/7

* cited by examiner

*Primary Examiner* — Tyrone V Hall, Jr.
(74) *Attorney, Agent, or Firm* — Alan D. Kamrath; Karin L. Williams; Mayer & Williams PC

(57) ABSTRACT

A chain tool has a base body being cylinder like and having a groove formed in an end of the base body, and two wall portions being formed and faced each other on two sides of the groove. The two wall portions have two side surfaces. An inner thread portion is formed on the side surfaces along a direction of groove depth, the base body is laterally penetrated by the groove along a center of inner thread portion, a bottom portion connects the two wall portions and having a through hole formed therein and being coaxial to the inner thread portion; a drive bolt having a top rod and a screw rod being movably engaged with the inner thread portion, wherein the screw rod has a drive portion placed against to the top rod, the top rod is coaxially align to the through hole.

6 Claims, 9 Drawing Sheets

CHAIN TOOL

FIELD OF INVENTION

The present disclosure relates to a chain tool. In particular, the present disclosure is a chain tool used for assembling or disassembling a chain of vehicle, especially for bicycle.

BACKGROUND OF THE INVENTION

Please refer to FIG. 9, it is a conventional chain tool comprising a base body 91 and a groove 911. A blocking wall 912 is disposed in the groove 911, and the blocking wall 912 includes a hole 913. A screw rod 92 is locked and fixed to the base body 91. If a chain 93 is broken and is required to be replaced, a roller (not shown) set on the chain 93 is aligned with the hole 913 to dispose in the groove 911, and a chain pin (not shown) is aligned with the axle center of screw rod 92. Since the chain 93 is blocked by the blocking wall 912 and a leaning portion 914, the chain 93 is rotated by driving the screw rod 92. A top rod 921 moves and pushes said chain pin to make it extend or insert into the chain 93.

However, when the chain 93 is set into the groove 911, the roller is aligned with the hole 913, the blocking wall 912 and the leaning portion 914 are used to facilitate the chain 93 to be positioned, but the height of the blocking wall 912 is lower than that of the chain 93 so that the blocking wall 912 is unable to totally block the chain 93. Furthermore, when the top rod 921 pushes the chain pin, in order to avoid the top rod 921 being not aligned with the axle center of chain pin, the hand should press on the chain 93 to make the top rod 921 align with the axle center of chain pin. In addition, when the top rod 921 is rotated to push said chain pin, the chain 93 is blocked by the blocking wall 912. If the strength of blocking wall 912 is not strong enough, the blocking wall 912 will be deformed.

Thus, the most important of the present disclosure is that how to use the conventional chain tool to overcome the problem of said chain pin being incapable of aligning with the top rod 921. The above information disclosed in this section is only for enhancement of understanding of the background of the described technology and therefore it may contain information that does not form the prior art that is already known to a person of ordinary skill in the art.

SUMMARY OF THE INVENTION

The main purpose of the present disclosure is to solve aforesaid problem and is to provide a chain tool. When the chain pin of the chain is pushed by the top rod, the chain links in the base body would not have an unexpected movement, and the bottom of the groove in the base body has is adequate to bear the force from pushing the chain pin. The chain pin, which is able to connect the chain links, is maintained to align with the top rod while assembling or disassembling the chain. It is very convenient and effective in assembling or disassembling the chain.

In order to achieve the aforesaid purpose, the present disclosure provides a chain tool.

The chain tool of the present invention has a base body being cylinder like and having a groove formed in an end of the base body, two wall portions being formed and faced each other on two sides of the groove, the two wall portions having two side surfaces faced each other, the two side surfaces being shaped corresponding to an edge of chain links, an inner thread portion being formed on the side surfaces along a direction of groove depth, the base body being laterally penetrated by the groove along a center of inner thread portion, a bottom portion connecting the two wall portions and having a through hole formed therein and being coaxial to the inner thread portion;

A drive bolt having a top rod and a screw rod being movably engaged with the inner thread portion;

Wherein the screw rod has a drive portion placed against to the top rod, the top rod is coaxially aligned to the through hole.

Wherein the base body has a grip extended from the base body.

Many of the attendant features and advantages of the present disclosure will become better understood with reference to the following detailed description considered in connection with the accompanying drawings.

DETAILED DESCRIPTION OF THE PREFERRED EMBODIMENTS

Please refer to FIG. 1 to FIG. 8, those are structure diagrams for exemplary embodiments of the present disclosure.

Figure 1:
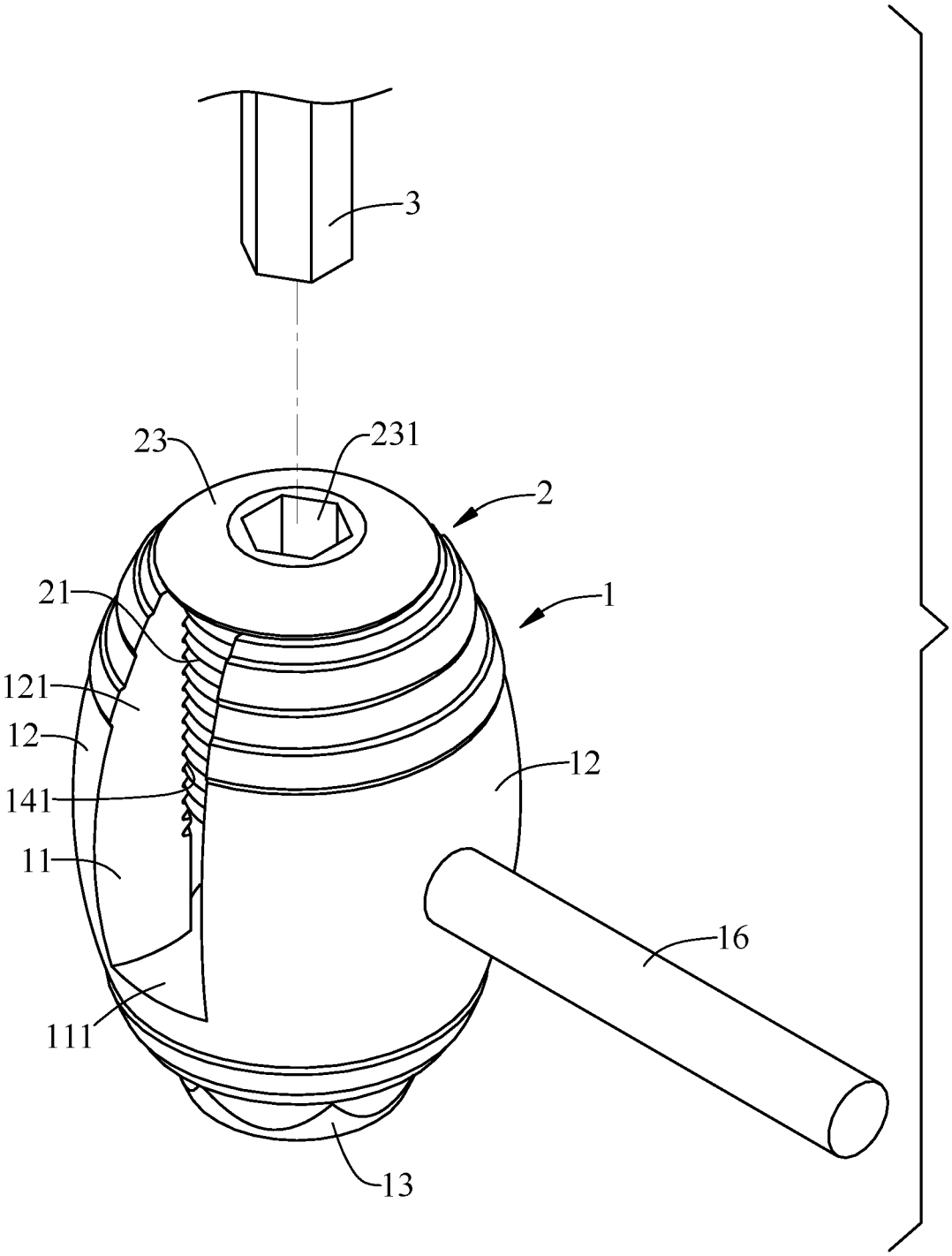
FIG. 1 is a stereoscopic diagram of an embodiment of the present disclosure.
Figure 2:
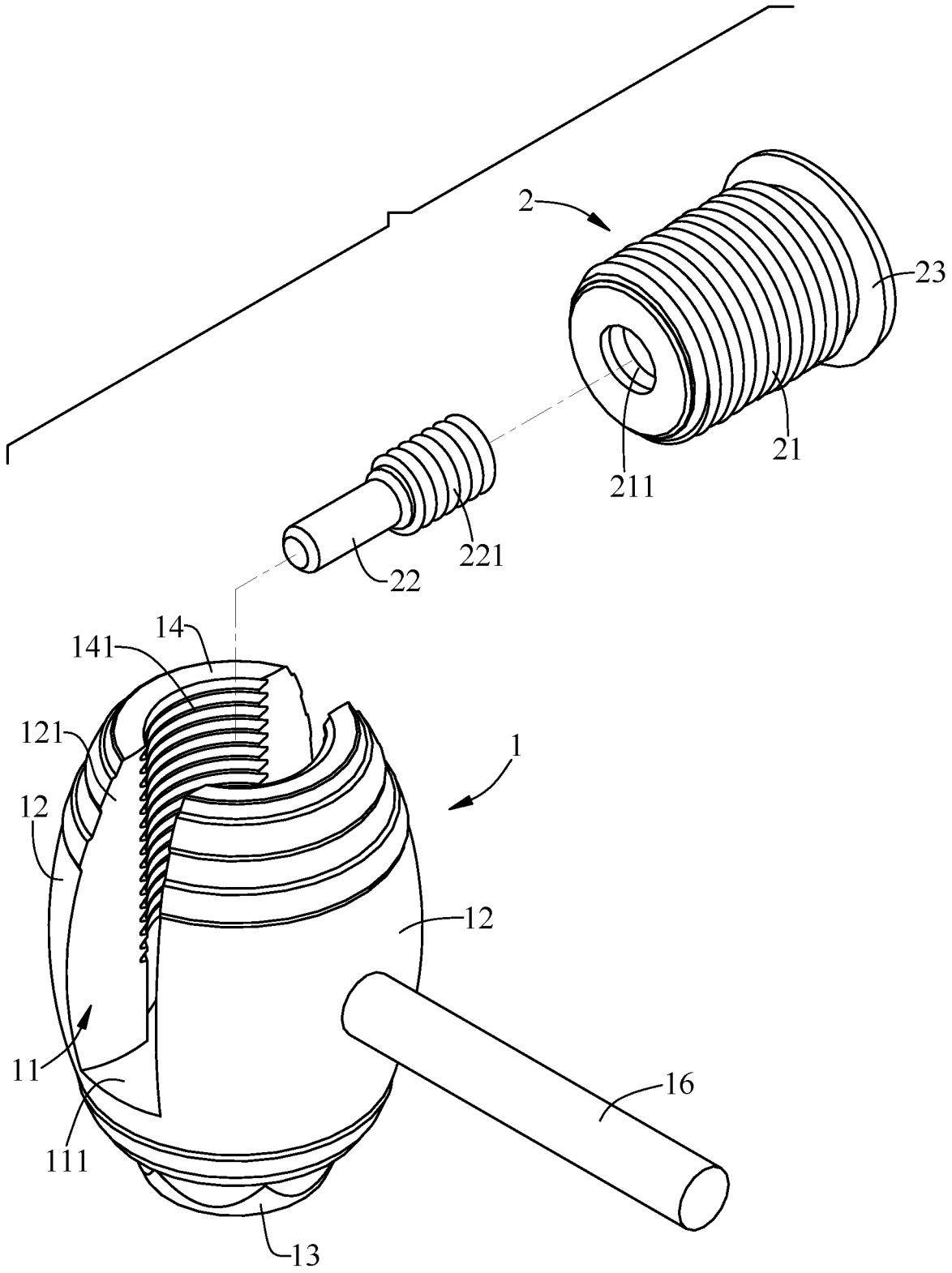
FIG. 2 is another stereoscopic diagram of the embodiment of the present disclosure.

The present disclosure provides a chain tool applied for a chain, the chain has a plurality of chain links connected by chain pins. The chain tool is used for pushing the chain pin to be inserted in the chain links or to be moved from the chain links. As shown in FIGS. 1 and 2, the chain tool comprises a base body 1 and a drive bolt 2.

Figure 3:
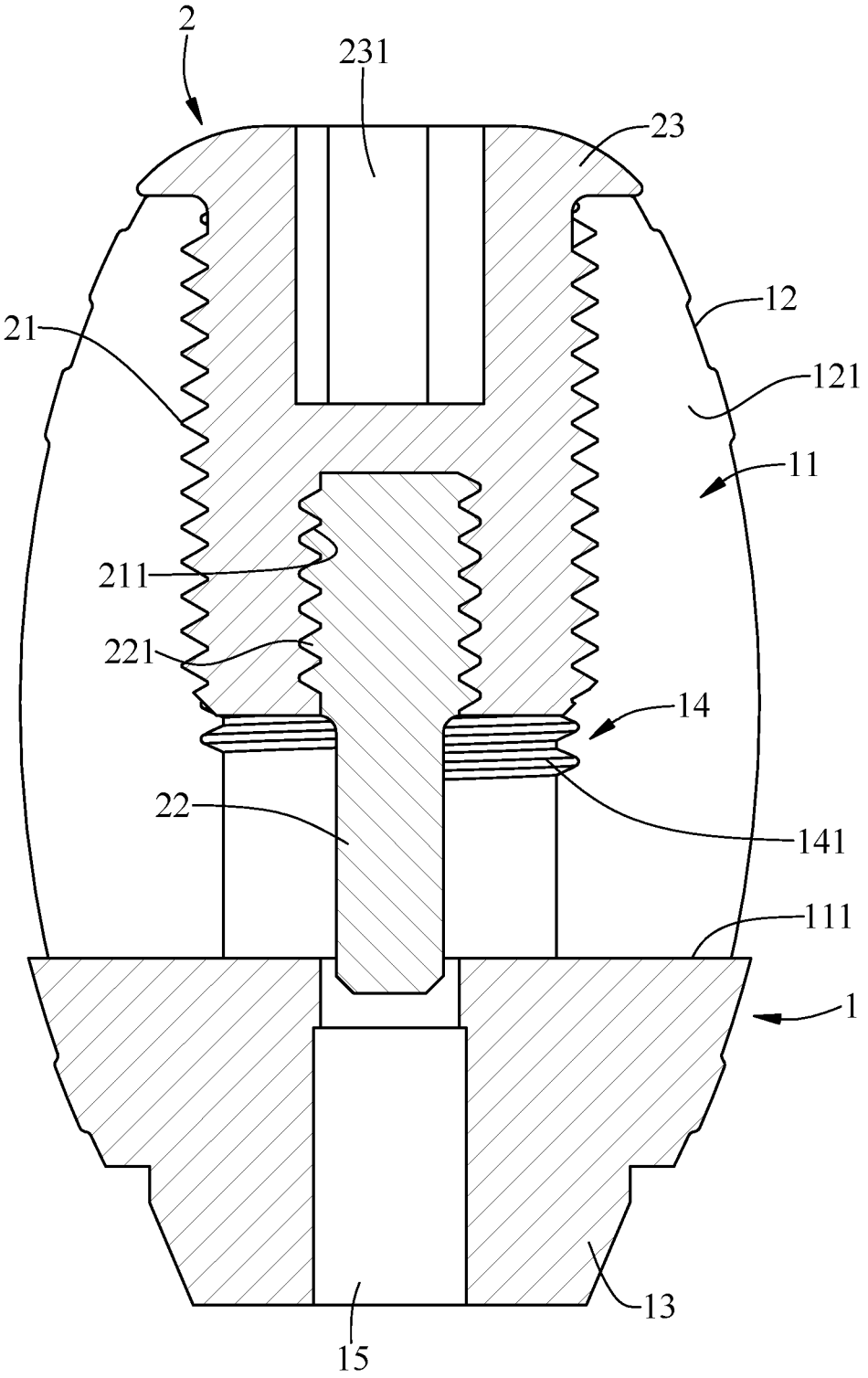
FIG. 3 is a longitudinal section diagram of the embodiment of the present disclosure.

As shown in FIGS. 2 and 3, the base body 1 is cylinder like and comprises a groove 11. The groove 11 is formed in the base body 1 from a first end of the base body 1 and the base body 1 is penetrated in width direction. The depth of groove 11 is larger than a length of the chain pin. The groove 11 accommodates all or a part of two chain links connected by the chain pin, which is axially inserted into the base body 1. In the preferred embodiment of the present disclosure, the base body 1 is shaped as ellipsoid like cylinder. The groove 11 is formed in the base body 1 from one end of base body 1, and penetrates through the base body 1 in lateral direction thereof.

Figure 4:
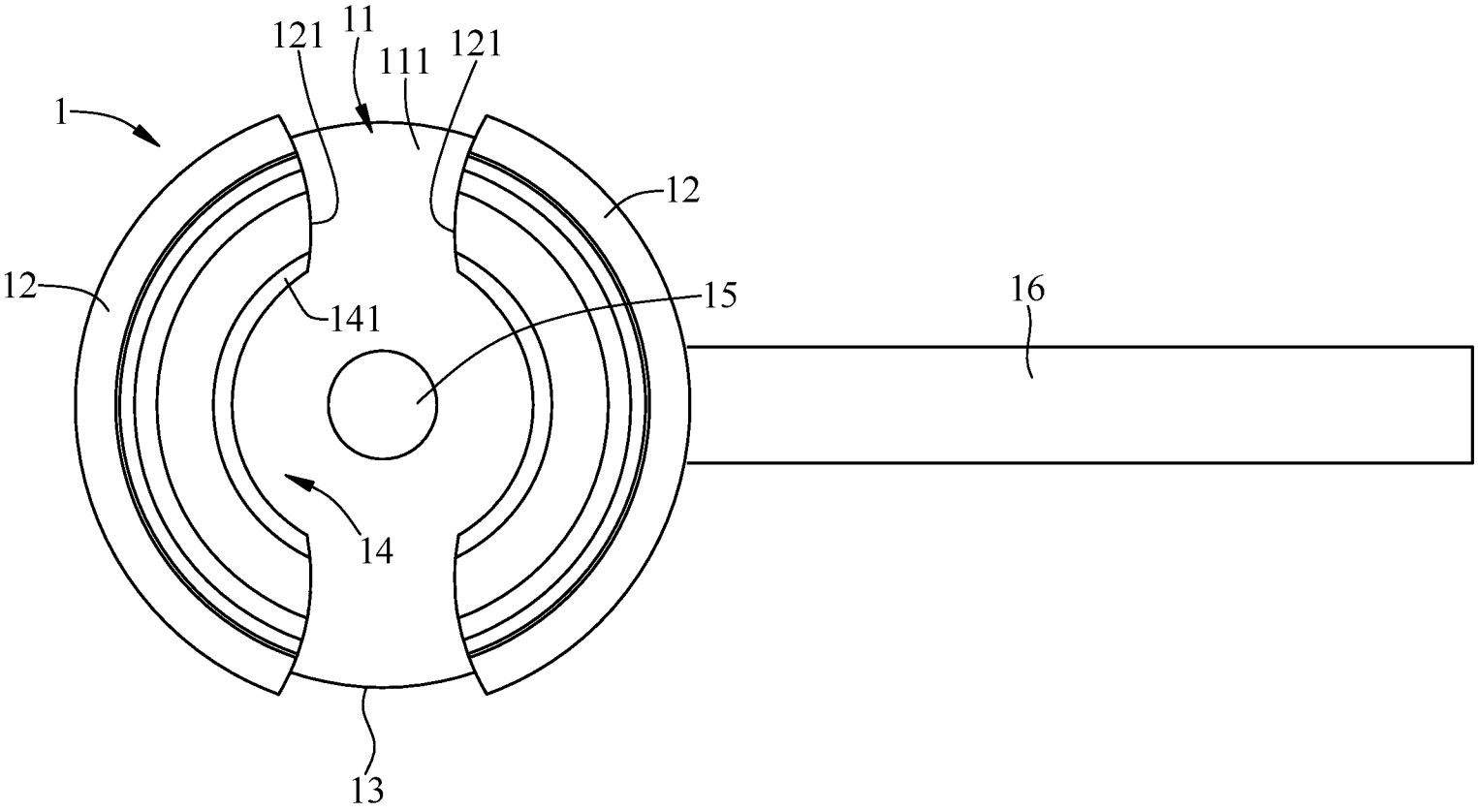
FIG. 4 is a top view of the base body from FIG. 2.

With reference to FIG. 2~FIG. 4, the base body 1 has two wall portions 12 and a bottom portion 13. The two wall portions 12 are defined in two sides of groove 11 and are faced each other. The bottom portion 13 is defined in a second end of the base body 1 and is not reached by the groove 11. The two wall portions 12 respectively have side surfaces 121 faced each other in the groove 11, and the two side surfaces 121 are shaped corresponding to the chain links. An inner thread portion 14 has an inner thread 141 being formed at the two side surfaces 121 along a longitudinal direction of the groove 11. The inner thread portion 14 is penetrated by the groove 11 along the center of inner thread portion 14. The bottom portion 13 has a through hole 15 communicated with the thread portion 14. The through hole 15 and the thread portion 14 are coaxial. An aperture of the through hole 15 is bigger than an outer diameter of the chain pin. In the preferred embodiment of the present disclosure, the base body 1 comprises a grip 16 mounted on one of the wall portions 12. The grip 16 is preferable extended toward a transverse direction of the inner thread portion 14. The grip 16 provides an user to hold the chain tool during operation.

With reference to FIG. 2 and FIG. 3, the drive bolt 2 comprises a screw rod 21. The screw rod 21 is movably engaged to the inner thread portion 14. The drive bolt 2 further comprises a top rod 22 and a drive portion. The top rod 22 is connected to one end of screw rod 21 that engaged with the base body 1. The top rod 22 and the through hole 15 are coaxial. The drive portion in this embodiment preferably has a head portion 23 located at one end of the screw rod 21 against to the top rod 22, the head portion 23 is used to drive screw rod 21 to move in the inner thread portion 14.

Figure 5:
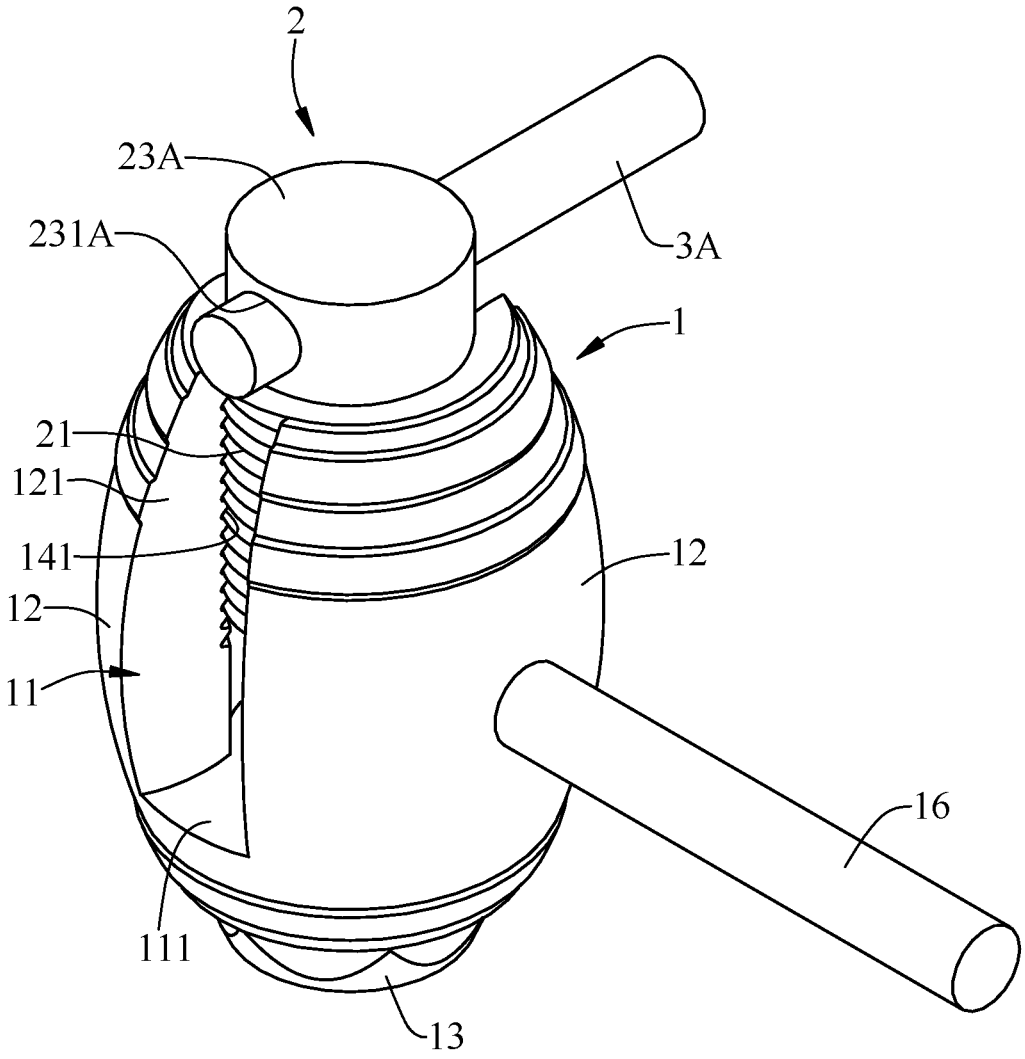
FIG. 5 is a stereoscopic diagram of another embodiment of the present disclosure.

In the preferred embodiment, the screw rod 21 and the top rod 22 may be detachably connected. The screw rod 21 of the drive bolt 2 has a screw hole 211 coaxially formed in the screw rod 21 and located in the opposite end of the top rod 22. The top rod 22 comprises an outer screw portion 221 being engaged in the screw hole 211. The head portion 23 of the drive bolt 2 may further comprise an inner hexagonal hole 231. With reference to FIG. 1, the inner hexagonal hole 231 is used for connecting with an Allen key 3 to drive the screw rod 22 being rotated. With reference to FIG. 5, the drive portion has a head portion 23A. The head portion 23A has a through hole 231A being laterally penetrated through the screw rod 21. An extension handle 3A is mounted into the through hole 231A for driving the screw rod 21 to rotate during operation. Furthermore, the drive bolt 2 may be a headless bolt without the head portion 23, 23A. The drive portion can be a hexagonal recess formed in an end of the screw rod 22.

Figure 6:
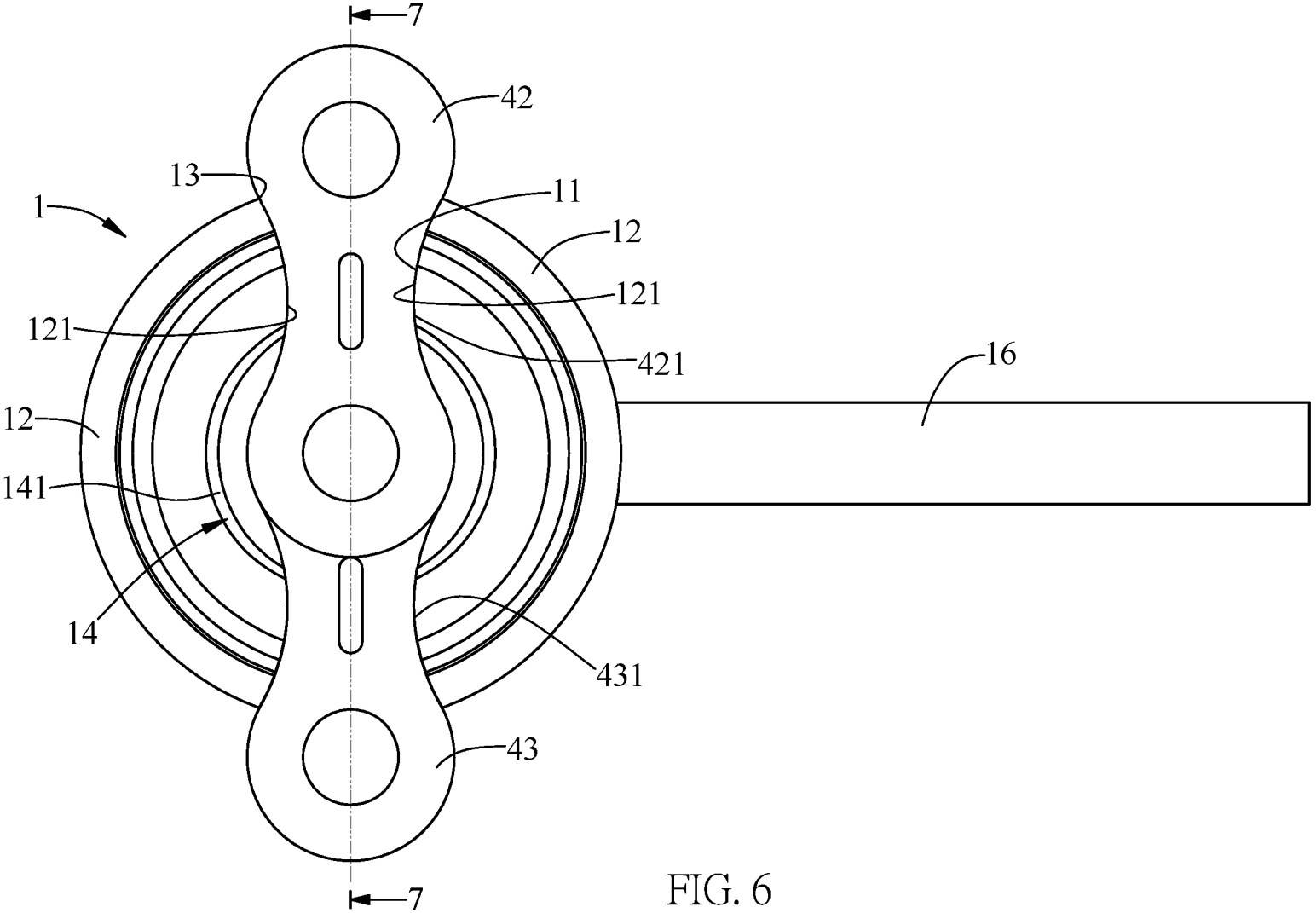
FIG. 6 is a top view of the chain links inserting into the groove of the base body from FIG. 4.
Figure 7:
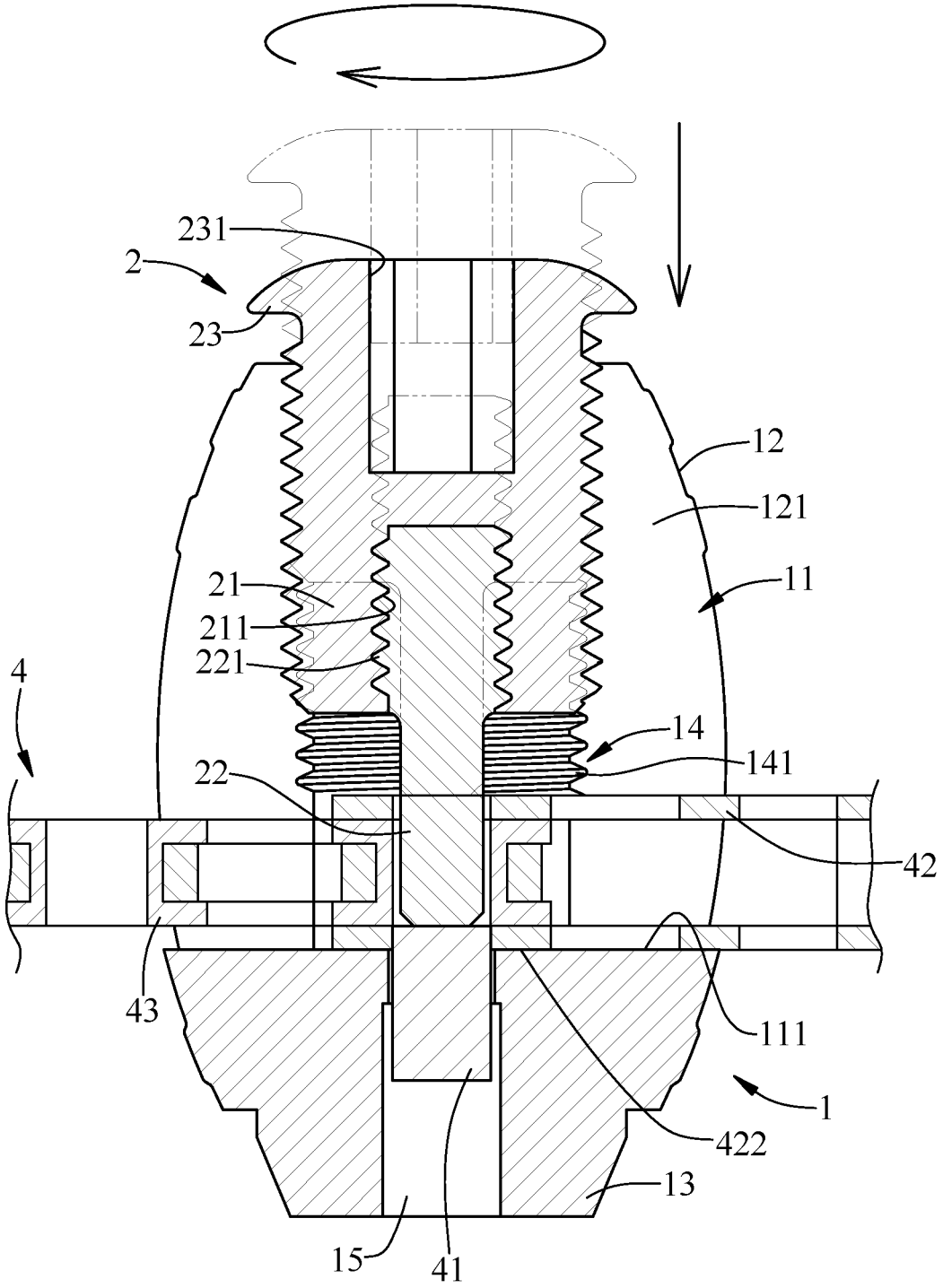
FIG. 7 is a longitudinal section diagram along the axle center of the screw rod from FIG. 6.
Figure 8:
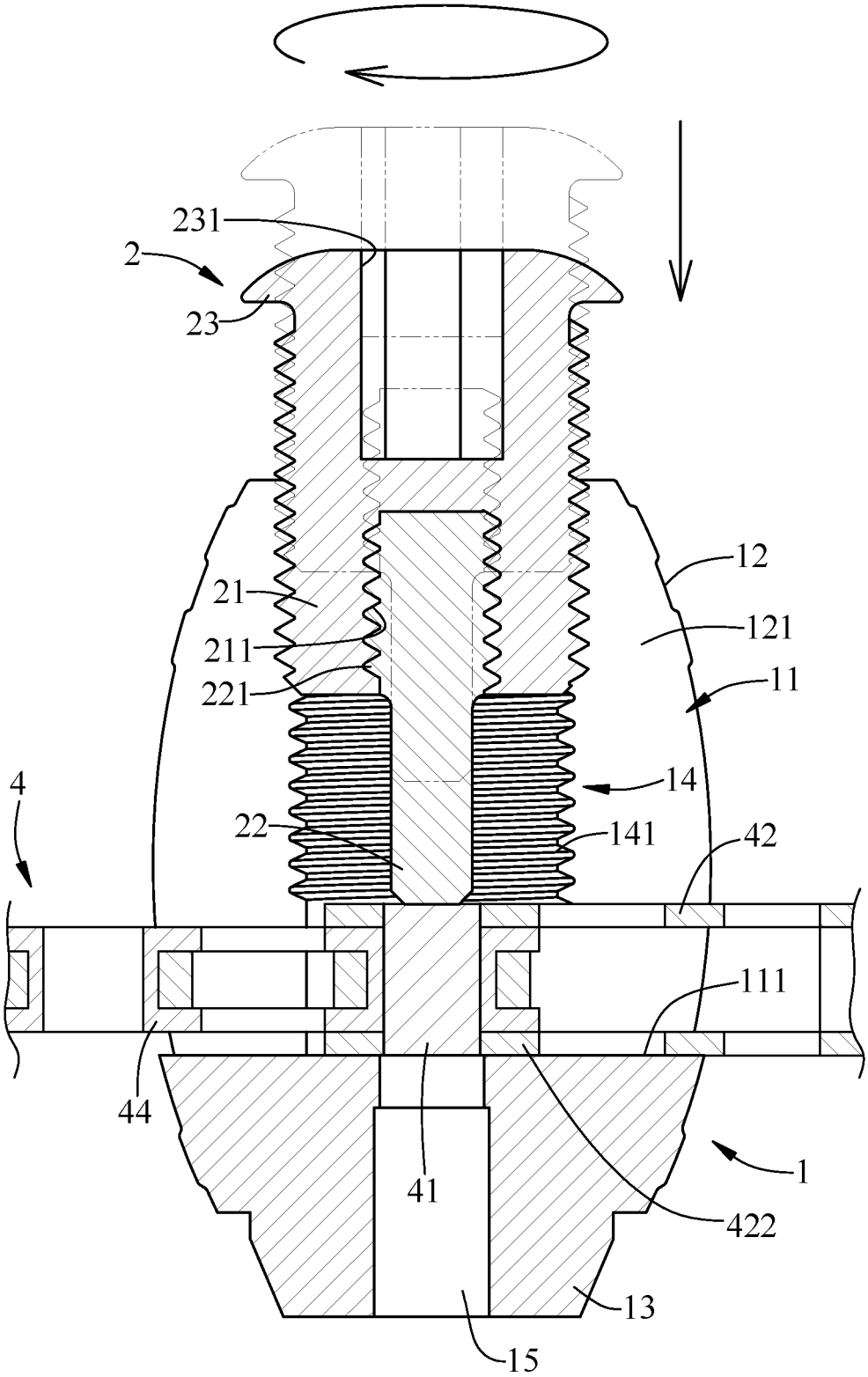
FIG. 8 is another longitudinal section diagram along the axle center of the screw rod from FIG. 6.
Figure 9:
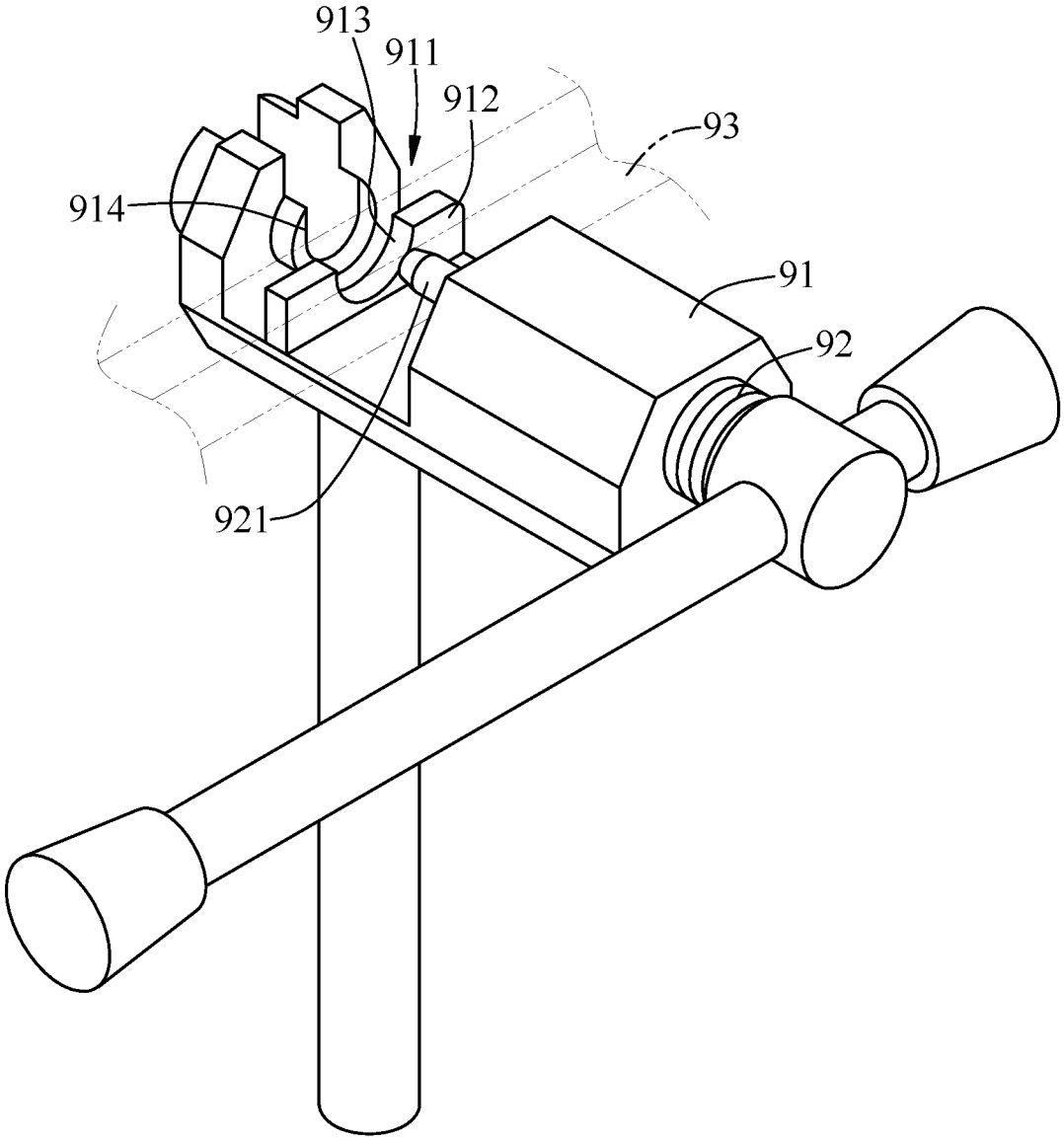
FIG. 9 (PRIOR ART)
FIG. 9 is a stereoscopic diagram of a conventional chain tool.

With reference to FIG. 6, a chain 4 may be placed in the groove 11, where the chain 4 comprises a chain pin 41 and two chain links 42 and 43. The chain pin 41 is placed in a base body 1 coaxially. Two side surfaces 121 are corresponding to edge sides 421 and 431 of the chain links 42 and 43. With reference to FIG. 7 and FIG. 8, a bottom surface 422 of the chain link 42 is placed on an upper surface 111 of the groove 11. Two chain links 42 and 43 are held in the groove 11 by corresponding shaped. The chain pin 41 is coaxially aligned with the through hole 15. When the screw rod 21 is moved into the inner thread portion 14 of the base body 1, the top rod 22 is coaxially aligned with the chain pin 4 and is rotated to push the chain pin 41 to be removed from or be inserted in the chain links 42 and 43.

With reference to FIG. 7, the chain pin 41 is inserted into the chain links 42 and 43. The two chain links 42 and 43 are partly disposed in the base body 1, and partly pushed out of the base body 1. The drive bolt 2 is rotated to drive the top rod 22 to push the chain pin 41 until the chain pin 41 is pushed to the location between the chain link 42 and the chain link 43. It should be noted that the chain pin 41 is temporarily disposed on the chain link 42. Please refer to FIG. 8, the chain link 42 is reversed and make the chain pin 41 upward (please see the dotted line), and another chain link 44 can be disposed into the base body 1 and connected with the chain link 42. The drive bolt 2 is rotated to drive the top rod 22 to push the chain pin 41 until the chain pin 41 being inserted to connect the chain link 42 and the chain link 44. In different embodiment of the present disclosure, the groove 11 included in the base body 1 can be designed to cover the chain link 42, 43, or 44 in the base body 1.

From aforementioned explanation, advantage of the present disclosure is that the chain links 42, 43, and 44 may be fitted in the groove 11 to prevent unexpected movement during assemble or disassemble the chain links.

It will be understood that the above description of embodiments is given by way of example only and that various modifications may be made by those with ordinary skill in the art.

The above specification, examples, and data provide a complete description of the present disclosure and use of exemplary embodiments. Although various embodiments of the present disclosure have been described above with a certain degree of particularity, or with reference to one or more individual embodiments, those with ordinary skill in the art could make numerous alterations or modifications to the disclosed embodiments without departing from the spirit or scope of this disclosure.

| LISTING OF REFERENCE NUMBERS | |
|---|---|
| <Prior Art> | |
| Base body 91 | Groove 911 |
| Blocking wall 912 | Hole 913 |
| Leaning portion 914 | Screw rod 92 |
| Top rod 921 | Chain 93 |
| <Present invention> | |
| Base body 1 | Groove 11 |
| Upper surface 111 | Wall portions 12 |
| Side surfaces 121 | Bottom portion 13 |
| Inner thread portion 14 | Inner thread 141 |
| Through hole 15 | Grip 16 |
| Drive bolt 2 | Screw rod 21 |
| Screw hole 211 | Top rod 22 |
| Screw portion 221 | Head portion 23 |
| Head portion 23A | Hexagonal hole 231 |
| Through hole 231A | Allen key 3 |
| Extension handle 3A | Chain 4 |
| Chain pin 41 | Chain link 42 |
| Edge sides 421 | Bottom surface 422 |
| Chain link 43 | Edge sides 431 |
| Chain link 44 | |

What is claimed is:

1. A chain tool comprising:

a base body being cylinder like and having a groove formed in an end of the base body, two wall portions being formed and faced each other on two sides of the groove, the two wall portions having two side surfaces faced each other, the two side surfaces being shaped corresponding to an edge of chain links, an inner thread portion being formed on the side surfaces along a direction of groove depth, the base body being laterally penetrated by the groove along a center of inner thread portion, a bottom portion connecting the two wall portions and having a through hole formed therein and being coaxial to the inner thread portion; and a drive bolt having a top rod and a screw rod being movably engaged with the inner thread portion;

wherein the screw rod has a drive portion placed against to the top rod, the top rod is coaxially aligned to the through hole.

2. The chain tool as claimed in claim 1, wherein the base body has a grip extended from the base body.

3. The chain tool as claimed in claim 1, wherein the screw rod comprises a screw hole formed coaxially in the screw rod, the top rod comprises an outer screw portion being movably engaged to the screw hole.

4. The chain tool as claimed in claim 1, wherein the drive portion comprises a head portion disposed at an end of the drive bolt, the head portion comprises an inner hexagonal hole.

5. The chain tool as claimed in claim 1, wherein the drive portion comprises a head portion disposed at an end of the drive bolt, and the head portion comprises a through hole laterally penetrated by the screw rod; an extension handle is inserted into the through hole.

6. The chain tool as defined in claim 1, wherein the inner thread portion is integrally formed at two side surfaces of the base body.

* * * * *